US007988252B2

(12) United States Patent
Risson et al.

(10) Patent No.: US 7,988,252 B2
(45) Date of Patent: Aug. 2, 2011

(54) METHOD OF ESTIMATING ALIGNMENT

(75) Inventors: Valery Risson, Barcelona (ES); Roma Segura Fabregas, Barcelona (ES); Alejandro Manuel De Pena, Barcelona (ES)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 11/491,189

(22) Filed: Jul. 24, 2006

(65) Prior Publication Data

US 2008/0170097 A1 Jul. 17, 2008

(30) Foreign Application Priority Data

Jul. 29, 2005 (GB) ..... 0515543.7

(51) Int. Cl.
*B41J 29/393* (2006.01)

(52) U.S. Cl. ..... 347/19; 347/5; 347/9

(58) Field of Classification Search ..... 347/19, 347/5, 9, 14, 15
See application file for complete search history.

(56) References Cited

U.S. PATENT DOCUMENTS

| | | | | |
|---|---|---|---|---|
| 5,600,350 | A | 2/1997 | Cobbs et al. | |
| 6,241,334 | B1 * | 6/2001 | Haselby | 347/19 |
| 6,334,720 | B1 * | 1/2002 | Kato et al. | 400/74 |
| 6,367,903 | B1 * | 4/2002 | Gast et al. | 347/9 |
| 6,450,607 | B1 * | 9/2002 | Bolash et al. | 347/19 |
| 6,582,052 | B2 * | 6/2003 | Sarmast et al. | 347/19 |
| 6,623,096 | B1 * | 9/2003 | Castano et al. | 347/19 |
| 6,908,173 | B2 * | 6/2005 | Otsuki et al. | 347/19 |
| 6,983,218 | B2 * | 1/2006 | Ruiz et al. | 702/151 |
| 7,044,573 | B2 * | 5/2006 | King et al. | 347/19 |
| 2003/0016978 | A1 | 1/2003 | Sarmast et al. | |
| 2003/0156148 | A1 | 8/2003 | King et al. | |
| 2004/0196325 | A1 * | 10/2004 | Castano et al. | 347/19 |
| 2006/0114283 | A1 * | 6/2006 | Mizes et al. | 347/19 |

FOREIGN PATENT DOCUMENTS

| | | | |
|---|---|---|---|
| EP | 1176802 | A2 * | 1/2002 |
| EP | 1 413 444 | | 4/2004 |

* cited by examiner

*Primary Examiner* — Lam S Nguyen

(57) ABSTRACT

The invention relates to a method of estimating the alignment in the printing medium direction between a first and a second pen of a printing system having a scan axis, whereby: the first, respectively second pen prints a first, respectively second pattern element; the first and second pattern elements are substantially aligned and separated by a space along the scan axis; each of the first and second pattern elements comprises a first and an associated second mark separated by a blank along the scan axis, the first and the second marks being staggered in the printing medium direction; an optical sensor scans along the scan axis over the first and second pattern elements, an analysis of the sensor output leading to estimating the alignment.

20 Claims, 2 Drawing Sheets

METHOD OF ESTIMATING ALIGNMENT

This application claims priority from Great Britain patent application 0515543.7, filed on Jul. 29, 2005. The entire content of the aforementioned application is incorporated herein by reference.

FIELD OF THE INVENTION

The present invention relates to a method of estimating the alignment in a printing medium direction between a first and a second pen of a printing system having a scan axis. Such a method is typically utilized in the field of printing where printers are used, each printer being equipped with one or more printing system, the printing system moving back and forth along a scanning axis for printing on a printing medium such as paper, the printing medium advancing in a printing medium direction.

BACKGROUND OF THE INVENTION

In an existing printer, a printing system carries a plurality of pens as illustrated in FIG. 1, each pen 10, 11 including a plurality of nozzles 100, 110, the nozzles forming two columns along the length of the pen, the length of the pen corresponding to the printing medium direction 1. The pens are located beside each other along the scan axis 2. Each pen is in theory perfectly aligned with the other pen, so that each nozzle 100 is associated and perfectly aligned to the corresponding nozzle 110 situated at the same level along the scan axis 2. In practice, as illustrated in FIG. 2, it may occur that a pen 12 results misaligned in the printing medium direction 1 with another pen 10. As a result, the nozzle 120 should not be associated with the theoretically corresponding nozzle 100, but with the following nozzle 101. It should be noted that in this particular case, there are four nozzles, 2 for each pen, which may be associated as being aligned along the printing medium direction. This is a reason to detect and estimate the alignment in the printing medium direction between a first and a second pen. In the existing printer, such an estimate is provided by scanning a dedicated interference pattern or by scanning a series of biased lines printed by each of the pens. Such methods of estimate are known in the art.

Separately, in an existing printer, the alignment of a nozzle in the scan axis is also estimated, this estimate being made by scanning a different pattern, this pattern being made of blocks. This estimate may be taken into account to be corrected in order to improve the quality of printing. If for example a nozzle is displaced towards one side of the scan axis, this displacement may be compensated by triggering the nozzle with an advance or with a delay. Such methods of compensation are known in the art.

SUMMARY OF THE INVENTION

The object of the invention is to provide an alternative method of estimating the alignment of a printing system pen in the printing medium direction.

In a first aspect, a method of estimating the alignment in the printing medium direction between a first and a second pen of a printing system having a scan axis is provided, whereby:

- the first, respectively second pen prints a first, respectively second pattern element;
- the first and second pattern elements are substantially aligned and separated by a space along the scan axis;
- each of the first and second pattern elements comprises a first and an associated second mark separated by a blank along the scan axis, the first and the second marks being staggered in the printing medium direction;
- an optical sensor scans along the scan axis over the first and second pattern elements, an analysis of the sensor output leading to estimating the alignment.

In a second aspect, a method of estimating the alignment in a scan axis of at least one nozzle of a first pen by scanning a printed pattern with an optical sensor is provided, whereby the scanning of said pattern further allows estimating the alignment in the printing medium direction between the first and a second pen of a printing system.

In a third aspect, a method of estimating the alignment of a printing system pen in the printing medium direction is provided, whereby the pen prints a pattern element comprising a first and a second mark separated by a blank along a scan axis of the printing system, the first and the second marks being staggered in the printing medium direction, whereby an optical sensor scans along the scan axis over the pattern element, the sensor output exhibiting a first, respectively second, peak corresponding to the first, respectively second, mark, whereby a comparison of the maximum value of the first peak with the maximum value of the second peak leads to estimating the alignment.

BRIEF DESCRIPTION OF THE DRAWINGS

The invention will now be elucidated by reference to a detailed embodiment partially illustrated schematically in the drawings.

DETAILED DESCRIPTION OF THE INVENTION

Figure 1:
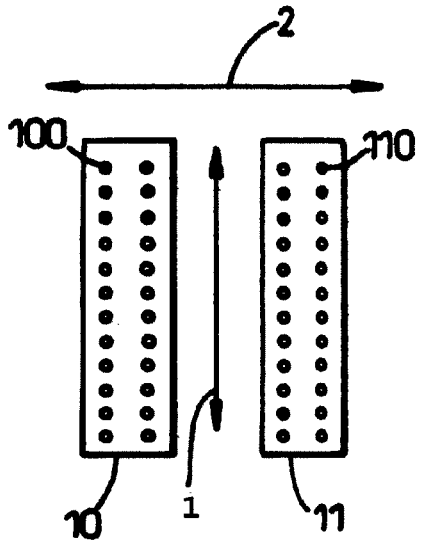
FIG. 1 shows a plurality of pens in a printing system.

In an embodiment of the first aspect, the first, respectively second pen prints a first, respectively second plurality of pattern elements, each plurality forming an array extending in the printing medium direction and in the scan axis. In an embodiment, each mark has a height along the printing medium direction, each first mark in the array being separated from the following first mark in the printing medium direction by a blank having the same height as the mark. In an embodiment, each second mark in the array is aligned in the scan axis with the blank separating two consecutive first marks.

In an embodiment of the first aspect, the first pen prints in a first color and the second pen in a second color, the first color being different from the second color.

In an embodiment of the first aspect, each pen comprises a plurality of nozzles, each nozzle pertaining to a primitive nozzle group, whereby all the nozzles used to print a mark are pertaining to the same primitive nozzle group. In an embodiment, all nozzles pertaining to a primitive nozzle group are used to print a mark.

In an embodiment of the first aspect, each mark and each blank separating a first and an associated second mark all have a similar length dimension along the scan axis.

In an embodiment of the first aspect, each first mark has a lower border and each associated second mark has an upper border, the bottom border and the upper border being substantially parallel to the scan axis, the lower border and the upper border being substantially aligned along a border line substantially parallel to the scan axis. In an embodiment, the optical sensor scans along the border line.

In an embodiment of the second aspect, the optical sensor produces a dataset, whereby the estimate of the alignment in the scan axis of the at least one nozzle and the estimate of the alignment in the printing medium direction between the first and the second pen are provided by analysis of the same dataset.

In an embodiment of the second aspect, the estimate of the alignment in the scan axis of the at least one nozzle and the estimate of the alignment in the printing medium direction between the first and the second pen are used to compensate deviations from ideal alignment values.

In an embodiment of the third aspect, the pen prints a plurality of pattern elements regularly spaced in the scan axis and separated by a space in the scan axis in order to obtain a plurality of measurements.

In an embodiment of the third aspect, the method is executed sing a plurality of pens, each execution using the same optical sensor. In an embodiment, the plurality of pen comprises at least two pens printing in different colors, whereby the sensor output is normalized for each color.

In an embodiment of the third aspect, the method is executed at a plurality of printing speeds.

In an embodiment of the third aspect, the method is executed in a first printing direction and in a second printing direction opposite to the first direction. In an embodiment, the printing direction is along the scan axis.

In an embodiment of the third aspect, the scan axis is substantially perpendicular to the printing medium direction.

Figure 2:
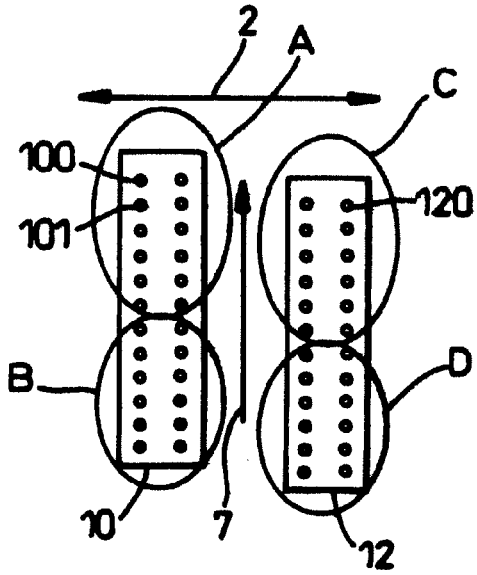
FIG. 2 shows a pen that is misaligned with another pen in the print medium direction.
Figure 3:
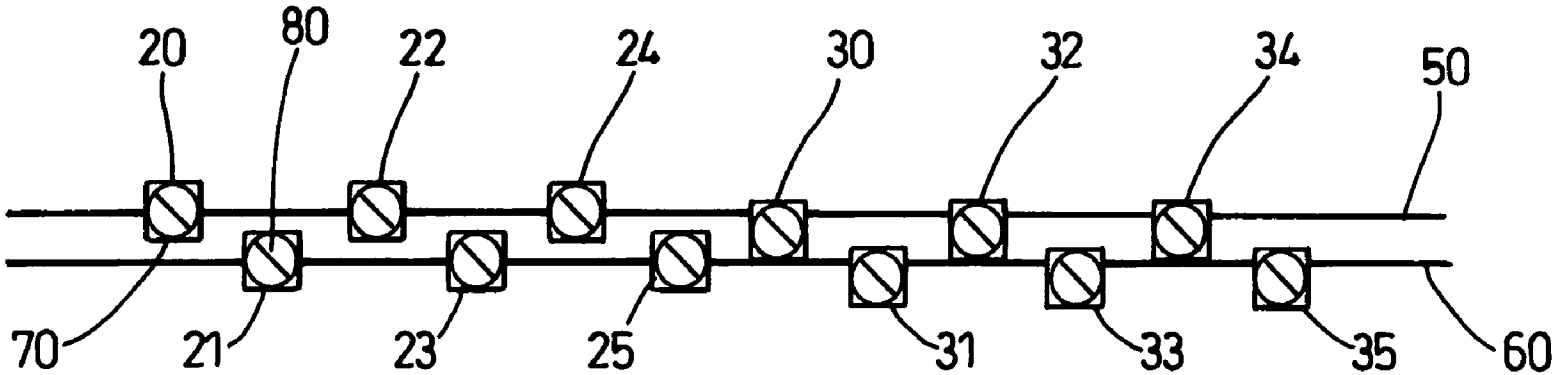
FIG. 3 shows a pattern according to an embodiment of the invention.

In the detailed embodiment of the invention, a printing system is provided, the printing system carrying two pens 10 and 12 as illustrated in FIG. 2. The printing system further comprises a carriage on which the pens are mounted. The printing system is used for printing on a sheet of paper the pattern illustrated in FIG. 3, whereby first pen 10 prints three first marks 20, 22 and 24 and three respectively associated second marks 21, 23 and 25 forming three first pattern elements (20, 21), (22, 23) and (24, 25), and whereby second pen 12 prints three first marks 30, 32 and 34 and three respectively associated second marks 31, 33 and 35 forming three second pattern elements (30, 31), (32, 33) and (34, 35). Each pen comprises two primitives, a first primitive A comprising the pens on one end of the pen, and a second primitive B comprising the nozzles on the other end of the pen. Each mark is printed using all nozzles of the same primitive so that marks 20, 22 and 24 are printed using all nozzles of primitive A of pen 10 and marks 21, 23 and 25 are printed using all nozzles of primitive B of pen 10. Similarly, marks 30, 32 and 34 are printed using all nozzles of primitive C of pen 1.2 and marks 31, 33 and 35 are printed using all nozzles of primitive D of pen 10. It should be noted that each pen may have more than two primitive, and that the primitives may be formed by one or more nozzles.

It should be noted that in this embodiment, pen 10 prints in black, whereas pen 12 prints in cyan. It should be noted that the printer is also equipped with a yellow pen and a magenta pen which are not represented here. In other embodiments, some or all of the pens may be of the same colour.

In this detailed embodiment, the scan axis is perpendicular to the printing medium direction.

Figure 4:
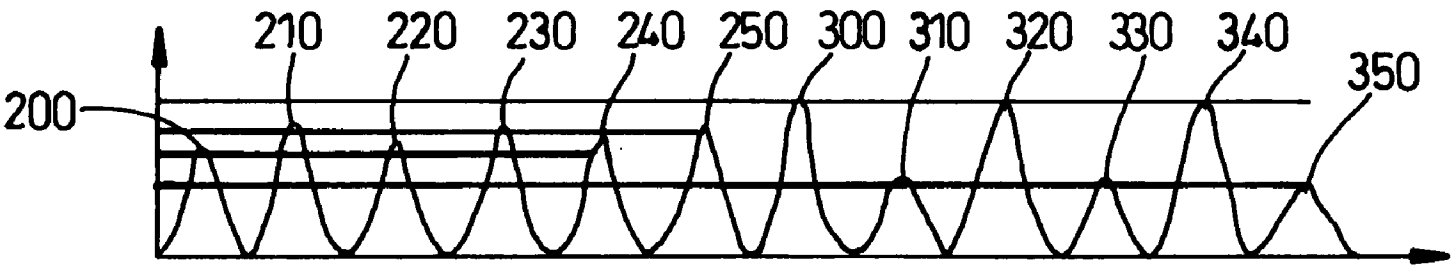
FIG. 4 shows the output of an optical sensor when scanning the pattern of FIG. 3.

After printing the pattern, an optical sensor is used for scanning over the pattern elements. The field of view described by the sensor during the scan is represented by the region comprised between the virtual lines 50 and 60. Lines 50 and 60 are not real lines. The output of the scan is represented by the series of peaks of FIG. 4 where each peak 200 to 350 is associated with a respective mark 20 to 35. The scan may be provided in the form of a dataset. As illustrated in FIG. 4, the peaks have a height dependent on the area of the related mark as "seen" by the sensor, in so far as a peak is higher if a larger part of the mark is "seen" by the sensor, and a peak is lower if a smaller part of the mark is "seen" by the sensor. The output is processed by calculating the ratio between the maximum values of the two peaks representative of a given pattern element, whereby a ratio of one implies that the optical sensor passed exactly on the border line of the pen. In this particular example, the outcome of the scan is that the optical sensor is more aligned with the border line of the first patterns than with the border line of the second patterns.

The amount of misalignment between the optical sensor and each pen, and thereby between pens, is therefore deduced from the output of the scan. It should be noted that the absolute value of the misalignment is related to the ratio between maximum values for a given pattern element, whereas the sign of the misalignment is given by the increasing or decreasing order of the maximum values for a given pattern element. For example, if the pen 12 was misaligned of the same amount but in the opposite direction, peaks 310, 330 and 350 would be higher than peaks 300, 320 and 340.

It should be noted that each first and second pattern elements are substantially aligned in so far as each first and second pattern elements would be exactly aligned if the pens were themselves exactly aligned. Each first pattern element is separated from any second pattern element along the scan axis by a space in order for the optical sensor to differentiate the output produced by each pattern element. In the same manner, the marks are also separated by a blank in order for the optical sensor to differentiate the output produced by one mark from the output produced by another mark along the scan axis. In order to facilitate treatment or analysis of the sensor output, the pattern elements and the marks are regularly spaced in the scan axis as well as in the printing medium direction.

In the detailed embodiment, each mark has a dimension along the scan axis which is the same as any other mark. The blank between marks also has that same dimension along the scan axis. In an embodiment, this dimension along the scan axis corresponds to a characteristic of the optical sensor whereby the sensibility of the optical sensor allows "seeing" each mark independently and thereby allows avoiding or minimizing overlap in the output or in the dataset between one mark and another.

In the detailed embodiment, each first mark 20 has a lower border 70 and each associated second mark 21 has an upper border 80, the bottom border and the upper border being substantially parallel to the scan axis, the lower border and the upper border being substantially aligned along a border line substantially parallel to the scan axis. In the detailed embodiment, the border line is parallel to lines 50 and 60, and is a different line for the marks printed by the first pen than for the marks printed by the second pen, both border lines being parallel and being separated by a space corresponding to the misalignment between the first and the second pen. The sensor scans substantially along the border line, substantially because the border line as explained is not precisely the same for both pens.

In the detailed embodiment, the position of each peak produced by the output of the scan along the scan axis provides an estimate of the alignment in the scan axis of the nozzles used for printing the respective mark. In this embodiment, the method provides both an estimate of the alignment of one or more nozzles in the scan axis as well as the alignment in the printing medium direction of the pen, thus leading to a significant time saving compared to known method where both estimates were provided using different patterns and different scans when calibrating a printing system.

In the detailed embodiment, each first pattern element is printed three times and each second pattern element is also printed three times. It should be noted that the pattern elements may be printed once or more times, in the scanning axis as exemplified in FIG. 3 or/an in the printing medium direction in order to have an entire array of pattern elements for measurement. In this manner, each pattern element may be exactly repeated to improve the quality of the measure, or may be repeated with a variation of conditions such as printing direction or printing speed. The pattern elements may also be printed for a variety of pens and in a variety of colors. When using different colors, it may be appropriate to normalize the value measured by the sensor to each color when comparing the measurements color to color. In an embodiment, the same sensor is used for all measurements, the sensor being located for example together with the printing system on the printing system carriage.

In an embodiment, the pattern elements are repeated along the printing medium direction, whereby each second mark is aligned in the scan axis with the blank separating two consecutive first marks in the scan axis. This is particularly suited to the case of a pen having more than two primitives following each other along its length, whereby every second primitive prints a first mark, every other primitive printing a second mark. In an embodiment, each mark has a height along the printing medium direction, each first mark in the array being separated from the following first mark in the printing medium direction by a blank having the same height as the mark. This is particularly suited to the case of a pen having primitives following each other along its length, whereby every second primitive prints a first mark, every other primitive printing a second mark, all primitives having the same height along the printing medium direction corresponding to the length of the pen.

In an embodiment, the pattern element of the invention has a first and an associated second mark which are staggered in the printing direction so that a "line of fire" is created by the staggered marks for the optical sensor scan.

It should be noted that in an embodiment, the alignment of only one pen is measured in the printing medium direction in relation to the scan axis as scanned by the optical sensor, whereby the high of the peaks obtained are compared to an expected or theoretical value.

The invention claimed is:

1. A method of estimating the alignment in a printing medium direction between a first pen and a second pen of a printing system, comprising:

printing a first pattern using a first pen;

printing a second pattern using a second pen;

wherein the first pattern and the second pattern are substantially aligned along a scan axis;

wherein the first pattern comprises a plurality of first marks printed by one or more nozzles associated with a first primitive group of the first pen, wherein the first pattern also comprises a plurality of second marks printed by one or more nozzles associated with a second primitive group of the first pen;

wherein the second pattern comprises a plurality of third marks printed by one or more nozzles associated with a third primitive group of the second pen, wherein the second pattern also comprises a plurality of fourth marks printed by one or more nozzles associated with a fourth primitive group of the second pen;

wherein the plurality of first marks and the plurality of second marks are staggered in relation to one another, and wherein the plurality of third marks and the plurality of fourth marks are staggered in relation to one another;

scanning along the scan axis over the first pattern and the second pattern;

outputting an optical sensor output, wherein the optical sensor output comprises a series of peaks, wherein each peak is associated with a mark and a height of each peak is dependent on the area of a mark detected by an optical sensor; and computing at least one ratio between the height of one of the series of peaks and at least another height of a different one of the series of peaks, and determining an amount of misalignment based on the at least one ratio.

2. A method according to claim 1, wherein each of the plurality of first marks is separated from a following first mark by a blank space, wherein the blank space is of equal distance between each of the plurality of first marks.

3. A method according to claim 2, wherein each of the plurality of second marks is aligned in a position parallel to the blank space separating two consecutive first marks of the plurality of first marks.

4. A method according to claim 1, wherein the first pen prints in a first color and the second pen prints in a second color, the first color being different from the second color.

5. A method according to claim 1, wherein the one or more nozzles associated with the first primitive group are only used to print the plurality of first marks.

6. The method of claim 1, wherein computing the at least one ratio comprises:

computing a first ratio between a first peak height corresponding to the first marks and a second peak height corresponding to the second marks; and computing a second ratio between a third peak height corresponding to the third marks and a forth peak height corresponding to the forth marks.

7. The method of claim 6, wherein determining the amount of misalignment comprises computing a difference between the first ratio and the second ratio.

8. The method of claim 6, comprising determining a sign of misalignment based on an increasing or decreasing order of the first peak height corresponding to the first marks and the second peak height corresponding to the second marks.

9. A device for estimating alignment, the device comprising:

a first pen configured to print a first pattern;

a second pen configured to print a second pattern; and an optical sensor configured to scan along a scan axis over the first pattern and the second pattern and produce an optical sensor output, wherein the optical sensor output comprises a series of peaks, wherein each peak is associated with a mark and a height of each peak is dependent on the area of a mark detected by an optical sensor;

wherein the first pattern and the second pattern are substantially aligned along the scan axis;

wherein the first pattern comprises a plurality of first marks printed by one or more nozzles associated with a first primitive group of the first pen, wherein the first pattern also comprises a plurality of second marks printed by one or more nozzles associated with a second primitive group of the first pen;

wherein the second pattern comprises a plurality of third marks printed by one or more nozzles associated with a third primitive group of the second pen, wherein the second pattern also comprises a plurality of fourth marks printed by one or more nozzles associated with a fourth primitive group of the second pen;

wherein the plurality of first marks and the plurality of second marks are staggered in relation to one another, and wherein the plurality of third marks and the plurality of fourth marks are staggered in relation to one another;

wherein the device is configured to compute at least one ratio between the height of one of the series of peaks and at least another height of a different one of the series of peaks, and determine an amount of misalignment based on the at least one ratio.

10. The device of claim 9, wherein the at least one ratio comprises a first ratio between a first peak height corresponding to the first marks and a second peak height corresponding to the second marks; and a second ratio between a third peak height corresponding to the third marks and a forth peak height corresponding to the forth marks.

11. The device of claim 10, wherein the device is configured to determine an amount of misalignment by computing a difference between the first ratio and the second ratio.

12. The device of claim 10, wherein the device is configured to determine a sign of misalignment based on an increasing or decreasing order of the first peak height corresponding to the first marks and the second peak height corresponding to the second marks.

13. A device for estimating alignment, the device comprising:

means for printing a first pattern;

means for printing a second pattern;

means for scanning along a scan axis over the first pattern and the second pattern and produce an output, wherein the output comprises a series of peaks, wherein each peak is associated with a mark and a height of each peak is dependent on the area of a mark detected by the means for scanning;

wherein the first pattern and the second pattern are substantially aligned along the scan axis;

wherein the first pattern comprises a plurality of first marks printed by one or more printing means associated with a first primitive group of the means for printing the first pattern, wherein the first pattern also comprises a plurality of second marks printed by one or more printing means associated with a second primitive group of the means for printing the first pattern;

wherein the second pattern comprises a plurality of third marks printed by one or more printing means associated with a third primitive group of the means for printing the second pattern, wherein the second pattern also comprises a plurality of fourth marks printed by one or more printing means associated with a fourth primitive group of the means for printing the second pattern;

wherein the plurality of first marks and the plurality of second marks are staggered in relation to one another, and wherein the plurality of third marks and the plurality of fourth marks are staggered in relation to one another; and means for computing at least one ratio between the height of one of the series of peaks and at least another height of a different one of the series of peaks, and determining an amount of misalignment based on the at least one ratio.

14. A device according to claim 13, wherein each of the plurality of first marks is separated from a following first mark by a blank space, wherein the blank space is of equal distance between each of the plurality of first marks.

15. A device according to claim 13, wherein the first pattern and the second pattern are printed in different colors, and wherein the means for scanning is normalized for each color.

16. A device according to claim 13, wherein the first pattern and the second pattern are printed at a plurality of printing speeds.

17. A device according to claim 13, wherein each of the plurality of second marks is aligned in a position parallel to the blank space separating two consecutive first marks of the plurality of first marks.

18. The device of claim 13, wherein the at least one ratio comprises:

a first ratio between a first peak height corresponding to the first marks and a second peak height corresponding to the second marks; and a second ratio between a third peak height corresponding to the third marks and a forth peak height corresponding to the forth marks.

19. The device of claim 18, wherein the device is configured to determine the amount of misalignment by computing a difference between the first ratio and the second ratio.

20. The device of claim 18, wherein the device is configured to determine a sign of misalignment based on an increasing or decreasing order of the first peak height corresponding to the first marks and the second peak height corresponding to the second marks.

* * * * *